United States Patent [19]

Newton, II

[11] Patent Number: 4,644,778

[45] Date of Patent: Feb. 24, 1987

[54] LANDSCAPE EDGING BENDER

[76] Inventor: William D. Newton, II, 2734 E. 45th Pl., Tulsa, Okla. 74105

[21] Appl. No.: 785,174

[22] Filed: Oct. 4, 1985

[51] Int. Cl.[4] ..... B21J 13/08
[52] U.S. Cl. ..... 72/457; 72/458
[58] Field of Search ..... 72/457, 458, 459

[56] References Cited

U.S. PATENT DOCUMENTS

| | | | |
|---|---|---|---|
| 2,750,823 | 6/1956 | La Casse | 72/458 |
| 2,817,986 | 12/1957 | Benfield | 72/459 |
| 3,888,101 | 6/1975 | Crees | 72/458 |

*Primary Examiner*—W. D. Bray
*Attorney, Agent, or Firm*—Head, Johnson & Stevenson

[57] ABSTRACT

A device for bending large radius bends or circles and small radius bends or right angles in metal plate, such as landscape edging.

27 Claims, 19 Drawing Figures

LANDSCAPE EDGING BENDER

BACKGROUND OF THE INVENTION

This invention pertains to devices for bending metal plate, and more particularly to devices for making large radius bends, circles, small radius bends, and right angles in metal plate and in steel edging used by landscape contractors.

In the past, there have not been tools commercially available to landscape contractors for bending the metal plate ("edging") which landscapers use as a separating border around rocks, shrubbery, trees, dirt, grass, etc. Landscapers were forced to either make large radius bends by hand or to go to sheet metal shops to have large radius bends and circles rolled in edging; and the common methods of forming small radius bends and right angles in edging were to weaken the bend point or create a kerf with an abrasive disc mounted on a power saw or to cut the edging and put the ends together to simulate a short radius bend.

Devices have been constructed in the past to bend pipe and conduit. U.S. Pat. Nos. 2,780,121 (White), 1,746,011 (Paratschek), 3,906,778 (Crouse) and 3,718,018 (Benfield) disclose pipe or conduit bending devices comprised of an arcuate bending element, a handle, and means for holding the workpiece against the arcuate bending element when the workpiece is being bent but are not suitable for bending metal plate or for making large radius bends for circles and small radius bends or right angles.

Devices have also been constructed in the past for bending small radius bends or right angles in flat metal test strips or in metal straps used for hanging pipe or conduit. U.S. Pat. Nos. 2,934,945 (Geenen et al.), 3,248,921 (Trout), and 3,604,244 (Thomas) are typical of such devices.

SUMMARY OF THE INVENTION

The present invention overcomes limitations in the prior art by providing landscapers and others with an inexpensive, portable tool which will easily and accurately bend large radius bends or circles and small radius bends or right angles in landscape edging and metal plate, and allows the use of the operator's foot to gain additional mechanical advantage in bending both large and small radius bends. By having such a device at the job site landscapers are able to more accurately custom bend landscape edging in a more time efficient and inexpensive manner than previously possible. The present invention thus offers a new and useful device not presently or previously available which will offer increased efficiency and profitability to the art of bending metal plate, particularly the art of bending landscape edging.

The metal plate bending device of the present invention, when used for bending large radius bends or circles, comprises: a rolling shoe comprised of a curved metal plate having a first end, a second end, an inside top surface, and an outside bottom surface; a handle attached to the rolling shoe; and first retention means, supported by the rolling shoe, for receiving and retaining the metal plate to be bent against the outside surface of the rolling shoe. The metal bending device may be used for bending small radius bends and right angles by using a stationary shoe in conjunction with the rolling shoe. The stationary shoe is comprised of a substantially planar metal plate having a first end, a second end, a top surface, and a bottom surface; and a second retention means, supported by the stationary shoe, for receiving and retaining the metal plate to be bent against the bottom surface of the stationary shoe. The stationary shoe is placed in tandem with the rolling shoe, the first end of the stationary shoe being adjacent the first end of the rolling shoe with the top surfaces of the shoes facing upwards. The metal plate to be bent is placed so that it extends through and is received and retained by the first and second retention means.

A further improvement includes a bent handle which can be attached to the metal plate bending device in two positions, allowing the bending device to be used to make both large and small radius bends and allowing the operators foot to be placed on the bending device to gain additional mechanical advantage.

DESCRIPTION OF THE PREFERRED EMBODIMENTS

Before explaining the present invention in detail, it is to be understood that the invention is not limited to its application to the details of construction and arrangement of parts illustrated in the accompanying drawings, since the invention is capable of other embodiments and of being practiced or carried out in various ways commensurate with the claims herein. Also it is to be understood that the phraseology or terminology employed herein is for the purpose of description and not of limitation.

Figures 1, 2, 3:
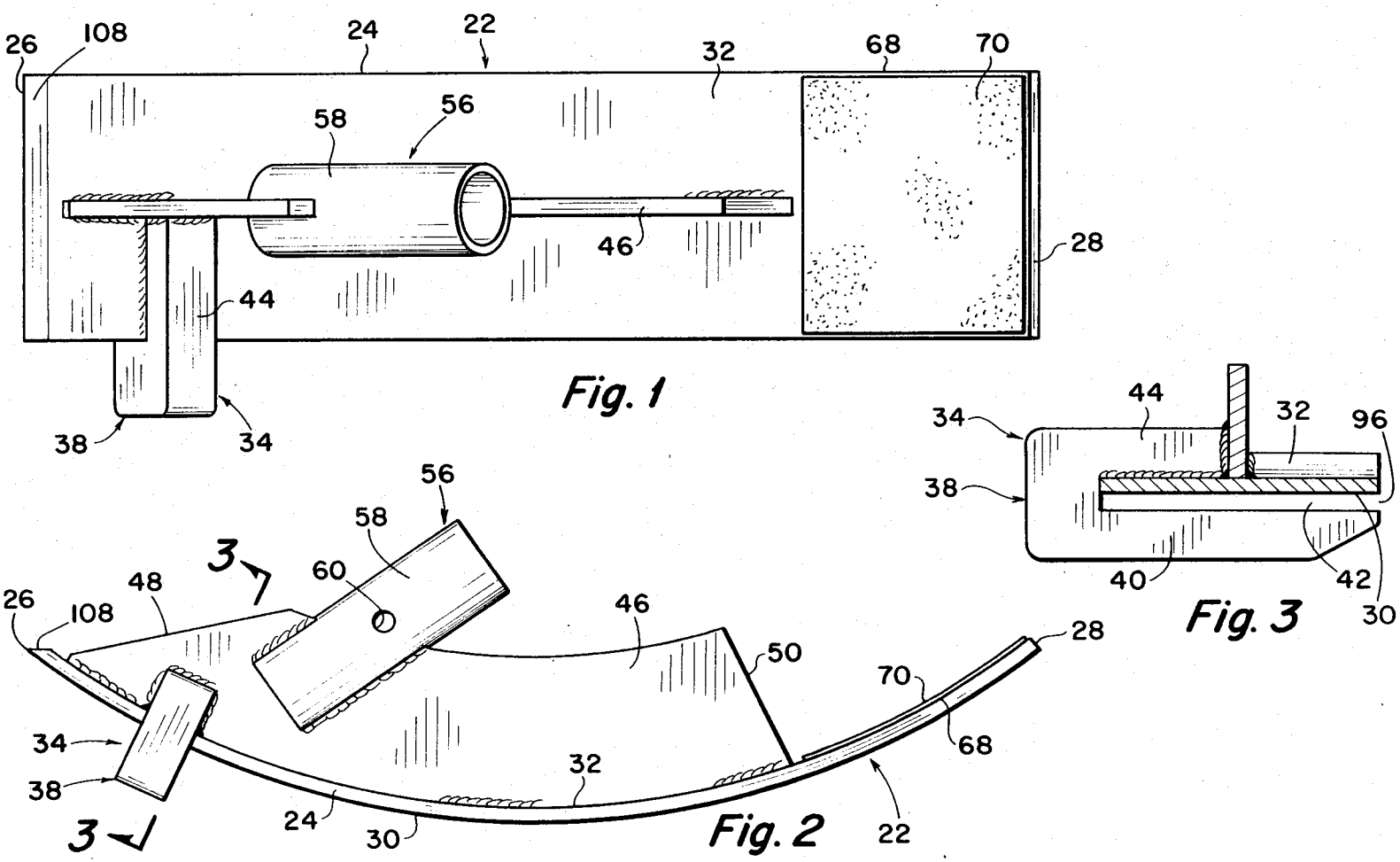
FIG. 1 is a top view of the rolling shoe.
FIG. 2 is a side view of the rolling shoe.
FIG. 3 is a cross-sectional view taken on line 3—3 of FIG. 1.
Figure 12:
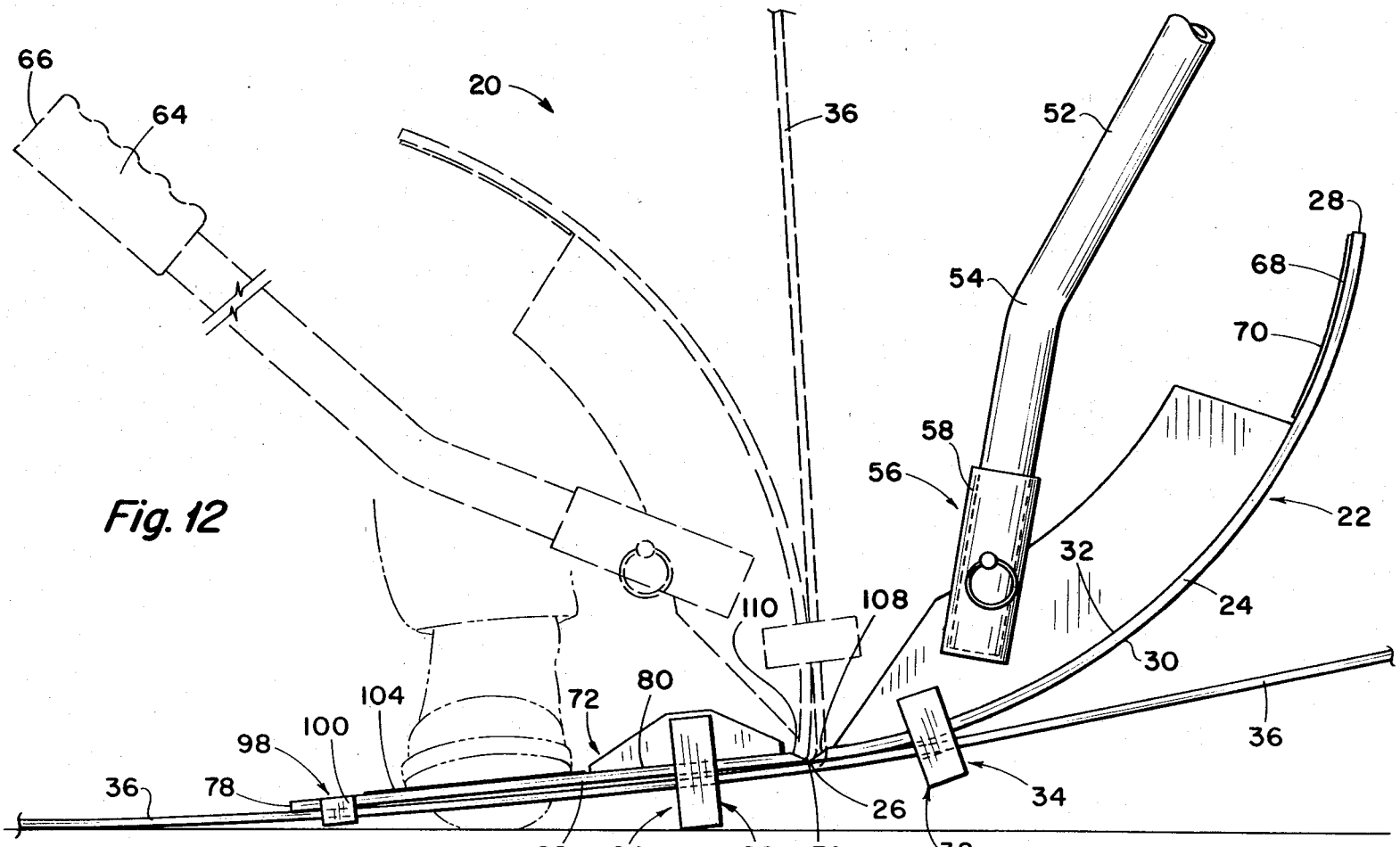
FIG. 12 is a side view of the initial and final (in phantom) positions of the metal bending device and workpiece when a small radius or right angle bend is made.

With reference to FIG. 12, the metal plate bending device of the present invention is generally designated by the reference numeral 20 and comprises a rolling shoe 22, better illustrated in FIGS. 1 and 2. The rolling shoe 22 is comprised of an elongated, curved metal plate 24, having a first end 26, a second end 28, an outside bottom surface 30, and an inside top surface 32. The illustrated, example embodiment of the curved metal plate 24 is 16 inches long, 4 inches wide and is made of $\frac{1}{4}$ inch thick metal plate. The curved metal plate 24 should be formed having a smooth and continuous curvature throughout its length in order to impart smooth and predictable bends to the metal plate being bent. The cross-sectional axes of the curved metal plate 24 should be substantially flat to prevent any curvature or bending in the cross-sectional axes of the metal plate being bent.

Figure 10:
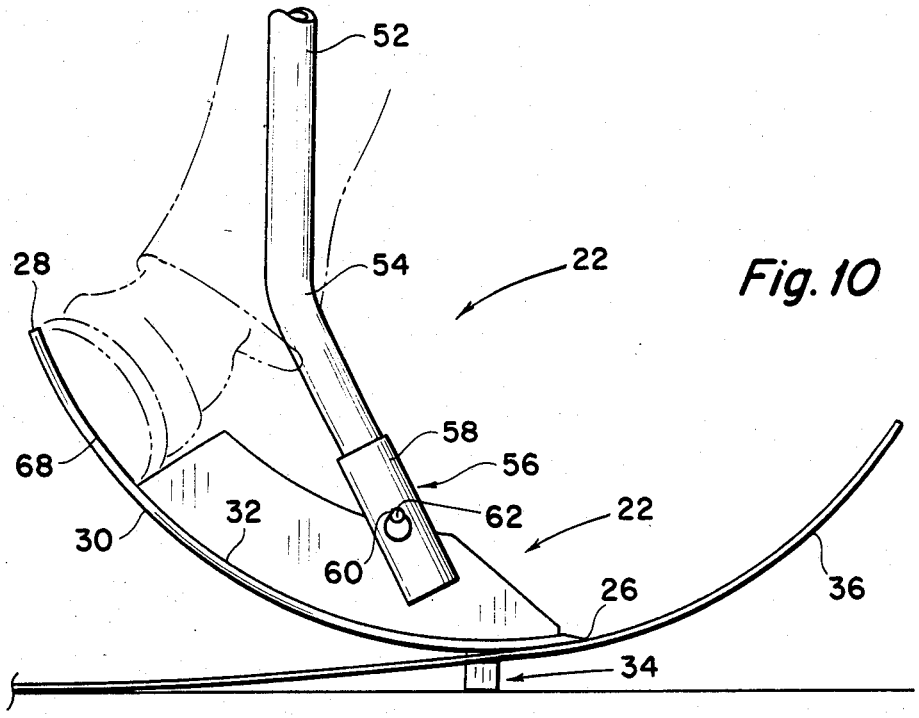
FIG. 10 is a side view of the initial position of the rolling shoe and workpiece when used to make a large radius bend or circle.
Figure 11:
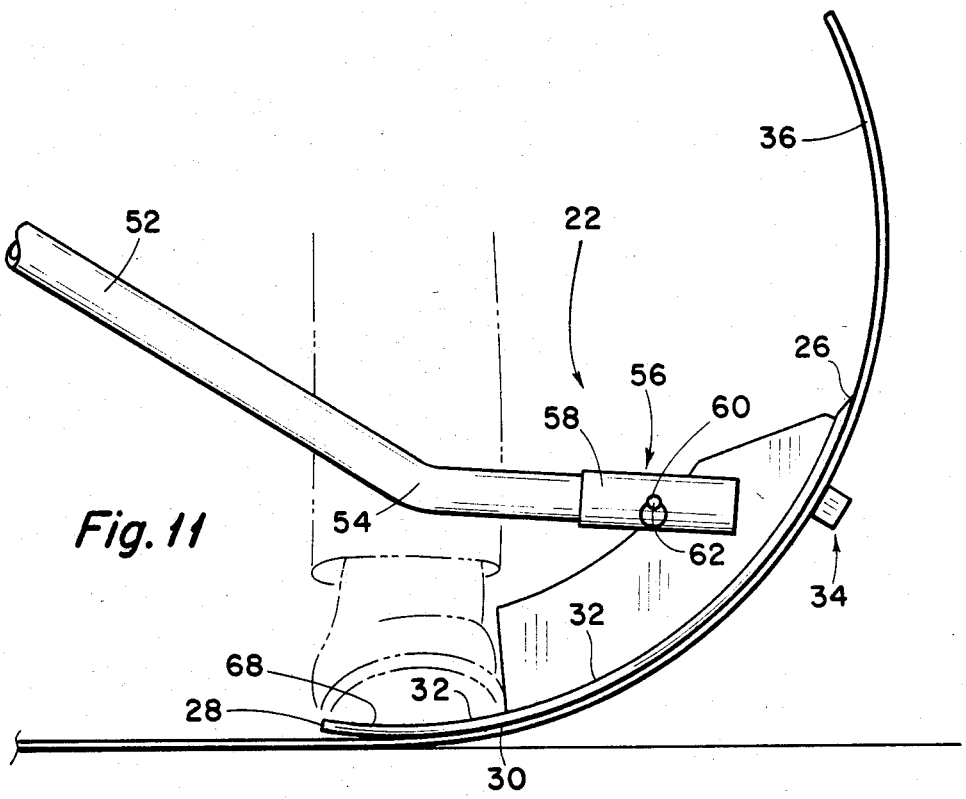
FIG. 11 is a side view of the final position of the rolling shoe and workpiece after a large radius bend has been made.

The rolling shoe 22 further comprises a first retention means 34 for receiving and retaining a workpiece of metal plate 36 to be bent against the outside surface 30 of the rolling shoe 22, as illustrated in FIGS. 10 and 11. As illustrated in FIGS. 1, 2, and 3, the first retention means 34 is typically comprised of a first retaining block 38 for retaining the metal plate 36 to be bent. The first retaining block 38 has an arm 40 which extends transversely across the outside surface 30 of the rolling shoe 22 near the first end 26 of the rolling shoe 22. The arm 40 of the first retaining block 38 is spaced away from the outside surface 30 of the rolling shoe 22 to create a first receiving space 42. The first receiving space 42 receives and retains the workpiece 36.

In the example embodiment the first retaining block 38 is made from $\frac{3}{4}$ inch metal plate in substantially the shape of a "C"; as illustrated in FIG. 3, with the shorter upper arm 44 of the "C" attached to the inside surface 32 of the rolling shoe 22 and the lower arm 40 of the "C" extending transversely across the outside surface 30 of the rolling shoe 22. In the illustrated embodiment the upper arm 44 of the first retaining block 38 is welded to the inside surface 32 of the rolling shoe 22, although other forms of attachment such as riveting, bolting, or pressing are acceptable. The distance between the outside surface of the rolling shoe 22 and the arm 40 of the first retaining should be sufficient block 38 to allow a length of metal plate to be bent in a continuous succession of bends without removing the metal plate from the device and without damaging or kinking the metal plate. In the example embodiment the distance between arm 40 and outside surface 30 is 7/32 inch to allow the device to be used for bending the most common thicknesses of metal plate used for landscape edging, i.e., $\frac{1}{8}$ inch and 3/16 inch.

As shown in FIGS. 1 and 2 the rolling shoe 22 further comprises at least one structural support 46 mounted along an arc of the inside surface of the rolling shoe 22. Typically, the structural support 46 extends along the inside surface 32 of the rolling shoe 22 from near the first end 26 of the rolling shoe 22 approximately three-fourths of the distance to the second end 28 of the rolling shoe. The structural support 46 is used to strengthen and give rigidity to the rolling shoe 22 and consequently minimize the thickness of the metal plate required to form the curved metal plate 24.

In the example embodiment, illustrated in FIGS. 1 and 2, there is one structural support 46 made of $\frac{1}{4}$ inch thick metal plate about $2\frac{1}{2}$ inches wide. In the example, one edge of the structural support 46 is spot welded along a laterally centered arc of the inside surface 32 of the rolling shoe 22 although other forms of attachment such as riveting, bolting, or pressing are recognized as acceptable. The first end 48 of the structural support 46 is beveled away from the first end 26 of the rolling shoe 22 to allow the rolling shoe to be used for bending small radius bends, as explained below, and the second end 50 of the structural support 46 is beveled away from the second end 28 of the rolling shoe 22 to allow the inside surface 32 near the second end 28 of the rolling shoe 22 to be used as a footing surface when bending large radius bends.

With reference to FIGS. 10 and 11, the metal bending device further comprises a handle 52 attached to the rolling show 22. The handle 52 is typically comprised of metal rod or metal-walled pipe or tubing and may be made of any length to accommodate the physique of the operator. In the example embodiment the handle 52 is made of 1 inch diameter, 14 gauge steel tube and is about 34 inches in length. The handle 52 may be attached to any point, preferably on the inside surface 32, of the rolling shoe 22. As illustrated in FIGS. 1 and 10, in the example embodiment the handle 52 is attached on the inside surface 32 near the first end 26 of the rolling show 22 and is generally radially mounted with the longitudinal axis of the handle parallel to a radial plane of the rolling shoe 22.

As illustrated in FIG. 10, in the example embodiment the handle 52 is bent, and the bend 54 is typically made about 6 inches from the end of the handle which is attached to the rolling show 22. The inside angle of the bend 54 is about 154 degrees in the example embodiment, and the handle is oriented such that the inside angle generally faces the first end of the rolling shoe 22. The bend 54 should be made at the angle and placement in the handle 52 and the length of the handle should be adjusted to allow the best combination of mechanical advantage and ease of use for the operator.

The rolling shoe 22 further comprises attachment means 56 for removably attaching the handle 52 to the inside surface of the rolling shoe 22 and properly orienting the inside angle of the handle with respect to the rolling shoe. In the example embodiment, as illustrated in FIGS. 1 and 2, the attachment means 56 is comprised of a metal socket 58 attached to the inside surface 32 of the rolling show 22 for removably engaging one end of the handle 52. The metal socket 58 is comprised of a section of 1 inch schedule 40 steel walled pipe in the example embodiment. The metal socket 58 may be mounted at any angle and at any point on the inside surface 32 of the rolling show 22. In the example embodiment the metal socket 58 is mounted near the first end 26 of the rolling show 22. The angle formed between the longitudinal axis of the metal socket 58 and the midpoint of the chord defined by the ends of the curved metal plate 24 is about 32 degrees in the example embodiment. Typically, the metal socket 58 is welded to the rolling shoe 22, or to the structural support 46 but any means of mounting such as riveting, bolting, or pressing is acceptable which will withstand the force exerted on the point of attachment when a metal plate 36 is bent with the metal bending device 20.

As illustrated in FIGS. 10 and 11, means for retaining the handle 52 within the metal socket 58 should be provided, such as threading or pins. In the illustrated example embodiment, a diametrical hole 60 is formed in the metal socket 58 and handle 52, and a pin 62 is inserted in the hole 60. In the example embodiment, the hole 60 is oriented in such a manner that it will hold the handle 52 with the inside angle of the bend 54 in a plane parallel with a radial plane of the rolling shoe 22.

As illustrated in FIG. 12, a handpiece 64 of rubber, plastic, or similar material should be placed on the outside end 66 of the handle 52 for the comfort and safety of the operator and to allow the operator to exert more force on the handle 52.

The inside surface 32 near the second end 28 of the rolling shoe 22 typically is provided with a first footing surface 68 that is clear of obstructions over an area extending from the second end 28 along the curvature of the inside surface 32 of the rolling shoe 22. The first footing surface 68 is used as a foot-operated lever, with the outside surface 30 of the rolling shoe 22 functioning as a fulcrum, and therefore provides a source of additional mechanical advantage for bending metal plate, as illustrated in FIGS. 10 and 11.

In the example embodiment, as illustrated in FIGS. 1 and 2, the first footing surface 68 is flush on the inside top surface 32 of the rolling shoe 22, although the height of the structural support 46 may be reduced and the length of the structural support extended so that the structural support 46 forms part of the footing surface 68. Also, in the example embodiment, the first footing surface 68 is covered with a covering 70 having a high coefficient of friction, such as 3M Company's Grade LT5 Safety Walk.

Figure 4:
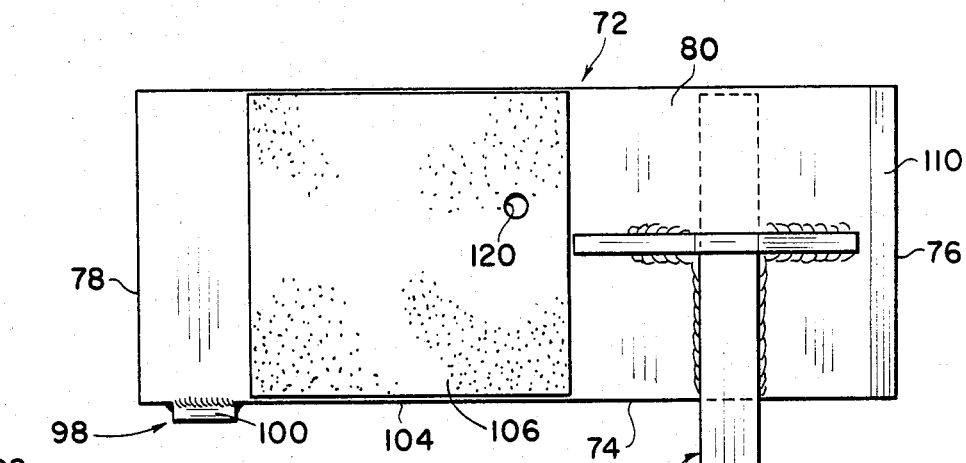
FIG. 4 is a top view of the stationary shoe.
Figure 5:
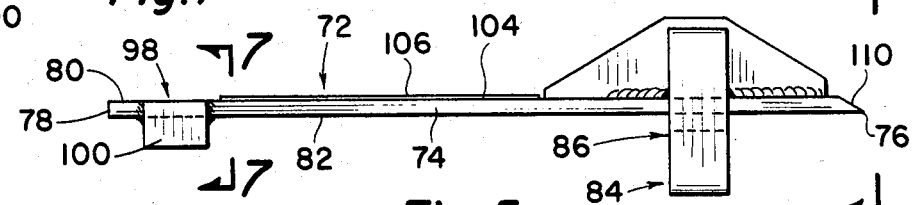
FIG. 5 is a side view of the stationary shoe.

Referring to FIGS. 4 and 5, the metal bending device further comprises a stationary shoe 72, the stationary shoe being comprised of a substantially planar metal plate 74 and having a first end 76, a second end 78, a top surface 80, and a bottom surface 82. In the illustrated example embodiment the planar metal plate 74 is made of $\frac{1}{4}$ inch metal plate and is about 4 inches wide and about 10 inches long. The planar metal plate 74 should be substantially planar in its cross-sectional axes to prevent imparting any curvature or bending to the cross-sectional axis of the workpiece 36.

Figure 6:
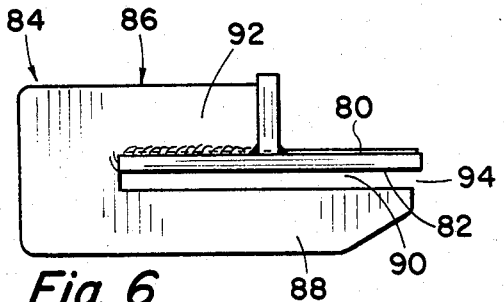
FIG. 6 is a cross-sectional view along line 6—6 of FIG. 4.
Figure 9:
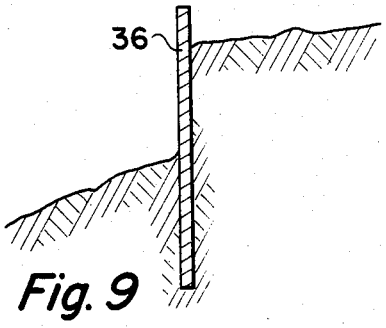
FIG. 9 is a cross-sectional view along line 9—9 of FIG. 7.
Figure 8:
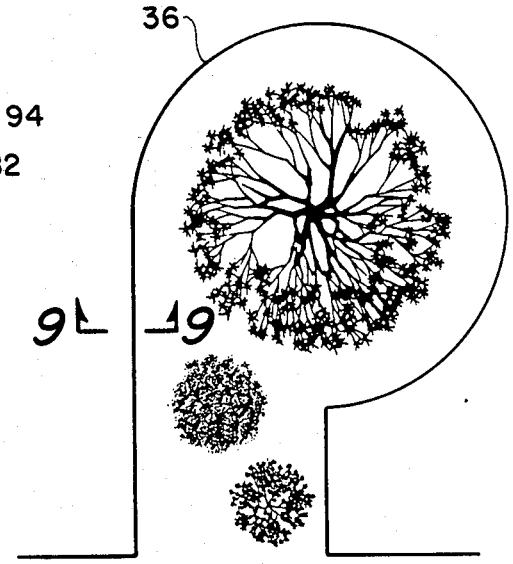
FIG. 8 is a plan view illustrating various typical bends which may be made in landscape edging with the present invention.

The stationary shoe 72 further comprises a second retention means 84 for receiving and retaining the workpiece 36 against the bottom surface 82 of the stationary shoe 72, as illustrated in FIGS. 4, 5, and 6. The second retention means 84 is typically comprised of a second retaining block 86 for holding the workpiece 36, better illustrated in FIG. 6. The second retaining block 86 has an arm 88 extending transversely across the bottom surface 82 of the stationary shoe 72 near the first end 76 of the stationary shoe 72. The arm 88 of the second retaining block 86 is spaced away from the bottom surface 82 of the stationary shoe 72 to create a second receiving space 90. The second receiving space receives and retains the workpiece 36.

In the example embodiment, the second retaining block 86 is made from $\frac{3}{4}$ inch metal plate in substantially the shape of a "C", as illustrated in FIG. 6, with the shorter, upper arm 92 fixed to the top surface 80 of the stationary shoe 72 and the lower arm 88 of the "C" extending transversely across the bottom surface 82 of the stationary shoe 72. In the example embodiment the upper arm 92 of the second retaining block 86 is welded to the top surface 80 of the stationary shoe 72, although other forms of attachment such as riveting, bolting or pressing, are recognized and acceptable.

The distance between the bottom surface 82 of the stationary shoe 72 and the lower arm 88 of the second retaining block 86 should be sufficiently larger than the thickness of the workpiece 36 to allow a short radius bend to be made in the workpiece 36 without damaging or kinking the workpiece. In the example embodiment the distance between arm 88 and bottom surface 82 is 7/32 inch to allow the device to be used for bending the most common thicknesses of metal plate used for landscape edging, i.e., $\frac{1}{8}$ inch, and 3/16 inch.

The open mouth 94 of the second receiving space 90 may face either side of the stationary shoe 72. In the example embodiment, the mouth 96 of the first receiving space 42 and the mouth 94 of the second receiving space 90 face the same side of the bending device 20 when the first end 26 of the rolling shoe 22 is adjacent the first end 76 of the stationary shoe 72 and the top surfaces 32 and 80 of the shoes are facing upward, as illustrated in FIG. 12. This orientation of the mouths 94 and 96 of the receiving spaces 42 and 90 allows easier insertion of the workpiece 36 and prevents twisting of the workpiece 36 during bending.

Figure 7:
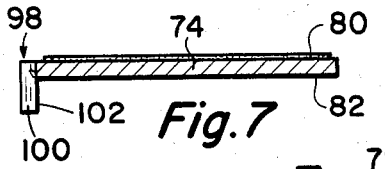
FIG. 7 is a cross-sectional view along line 7—7 of FIG. 5.

The stationary shoe 72 may also be provided with alignment means 98 to aid the operator in placing the workpiece 36 in proper alignment with the longitudinal axes of the stationary shoe 72 and the rolling show 22 as illustrated in FIGS. 4, 5, and 12. In the example embodiment, the alignment means 98 is an alignment block 100 and is located near the second end 78 of the stationary show 72 on the opposite side of the stationary shoe 72 from the open mouth 94 of the second receiving space 90. As illustrated in FIG. 7, the alignment block 100, in its example embodiment, has an alignment face 102 which is coterminous with the side of the stationary shoe 72 on which the alignment block 100 is attached, and the alignment face 102 extends from the side of the stationary shoe 72 beyond the bottom surface 32 of the stationary shoe a sufficient distance to catch the workpiece 36 as it is inserted and retain it in proper alignment with longitudinal axes of the rolling shoe 22 and stationary shoe 72. The alignment block 100 also helps prevent the workpiece from twisting out of proper alignment during bending. The alignment face 102 is flush with the side of the stationary shoe 72 and perpendicular to the bottom surface 82 of the stationary shoe. In the example embodiment, the alignment block 100 is made of 3/16 inch thick metal plate and is welded to the edge of the stationary shoe 72.

As illustrated in FIGS. 4 and 5, the top surface 80 adjacent the second end 78 of the stationary shoe 72 typically is provided with a second footing surface 104 that is substantially planar and clear of obstructions over an area of the top surface extending from the second end 78 of the stationary shoe 72. The second footing surface 104 allows the top surface 80 near the second end 78 of the stationary shoe 72 to be used by the operator as a foot rest to stabilize the metal bending device 20 when the device is used to bend metal plate. Also, in the example embodiment the second footing surface 104 is covered with a covering 106 having a high coefficient of friction, such as 3M Company's Grade LT5 Safety Walk, as illustrated in FIGS. 4 and 5.

As illustrated in FIGS. 1 and 2, in the example embodiment the first end 26 of the rolling shoe 22 is beveled, and the angled face of the bevel 108 is coterminous with the inside top surface 32 of the rolling shoe 22.

Likewise, as illustrated in FIGS. 4 and 5, in the example embodiment the first end 76 of the stationary shoe 72 is beveled and the angled face of the bevel 110 is coterminous with the top surface 80 of the stationary shoe 72.

In the example embodiment, both bevel 108 and bevel 110 are beveled at the same angle, the angle being about 38 degrees. The bevels 108 and 110 allow the bottom surfaces 30 and 82 of the first ends 26 and 76 of the rolling shoe 22 and stationary show 72 to remain substantially in contact as a small radius bend is made using the rolling shoe 22 and the stationary shoe 72, as illustrated in FIG. 12 and explained hereinafter.

There are at least two different uses for the metal bending device 20. In the first use, illustrated in FIG. 12, both the stationary shoe 72 and the rolling shoe 22 are used to make small radius and/or right angle bends in metal plate. The stationary shoe 72 is placed in tandem with the rolling shoe 22 with the first end 76 of the stationary shoe 72 adjacent the first end 26 of the rolling shoe and the top surfaces 32 and 80 of the shoes facing upward. The workpiece 36 is placed so that it extends through the first retention means 34 of the rolling shoe 22 and the second retention means 84 of the stationary shoe 72 and is received and retained in the first receiving space 42 of the first retention means and the second receiving space 90 of the second retention means. The handle 52 is placed in the metal sock 58 with the inside angle of the bend 54 facing the second end 28 of the rolling shoe 22. The workpiece 36 is then bent by moving the handle 52 in such a manner as to roll the rolling shoe 22 towards the stationary shoe 72, as illustrated in FIG. 12 in phantom. The second footing surface 104 is used to stabilize the metal plate bending device 20 and gain mechanical advantage as the handle 52 is moved and the workpiece 36 is bent.

In the second use, as illustrated in FIGS. 10 and 11, the rolling shoe 22 is used alone, to bend large radius bends and/or circles in metal plate. The workpiece 36 is positioned in the first retention means 34, as illustrated in FIG. 10. The handle 52 is positioned in the metal socket 58 with the inside angle of the bend 54 in the handle facing the first end 26 of the rolling shoe 22. The handle 52 is then moved toward the second end 28 of the rolling shoe 22 while simultaneously exerting force on the first footing surface 68 in such a manner as to roll the workpiece 26 around the outside surface 30 of the rolling shoe 22, as illustrated in FIGS. 10 and 11. Circles may be made in the metal plate using the rolling shoe 22 by executing the procedure above and then sliding the workpiece 36 through the first clamping space 42 and bending the workpiece again. Larger circles are made by bending more than a complete circle and then springing the bent workpiece 36 out into a circle. Smaller circles are made by bending less than a complete circle and then pulling the ends of the workpiece 36 together.

Figure 13:
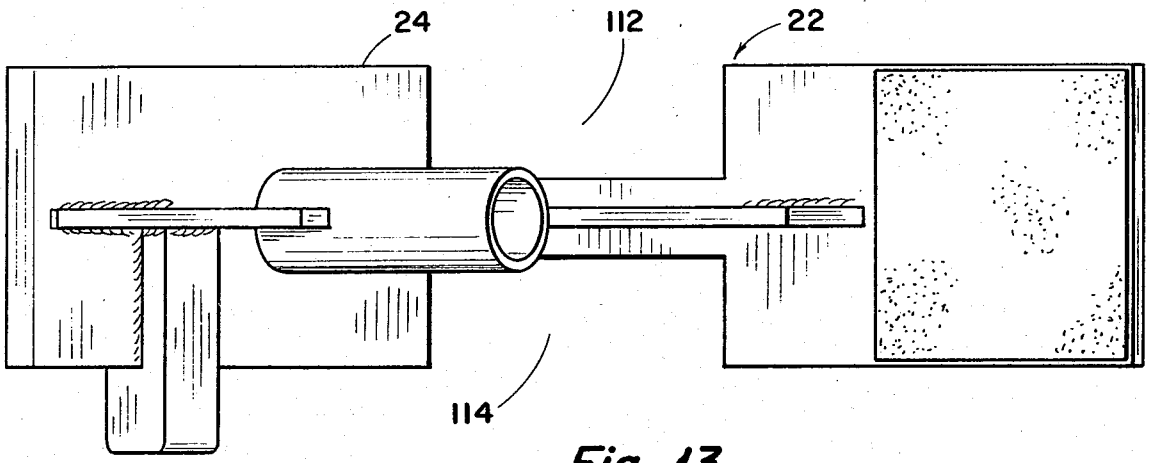
FIG. 13 is a top view of the rolling shoe modified for bending metal plate having integral projections.
Figure 14:
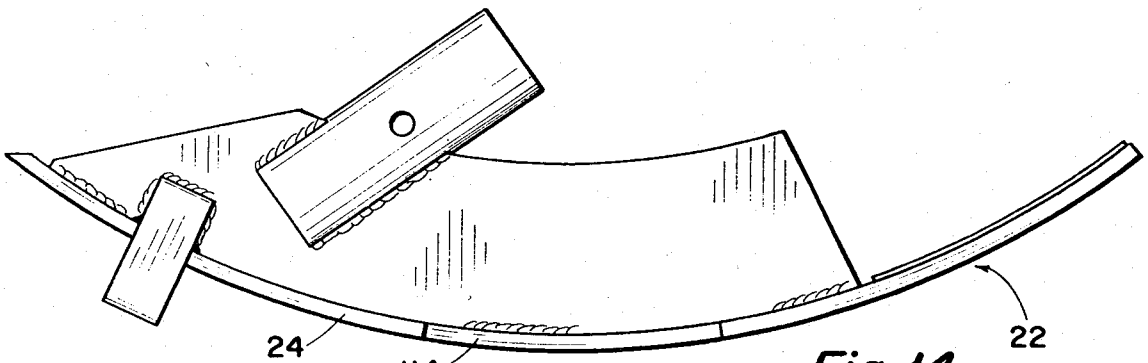
FIG. 14 is a side view of the rolling shoe modified for bending metal plate having integral projections.
Figure 16:
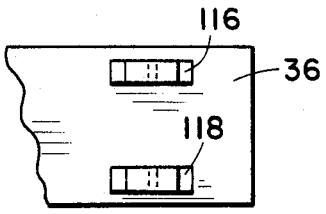
FIG. 16 is a cross-sectional view along line 16—16 of FIG. 15.
Figure 15:
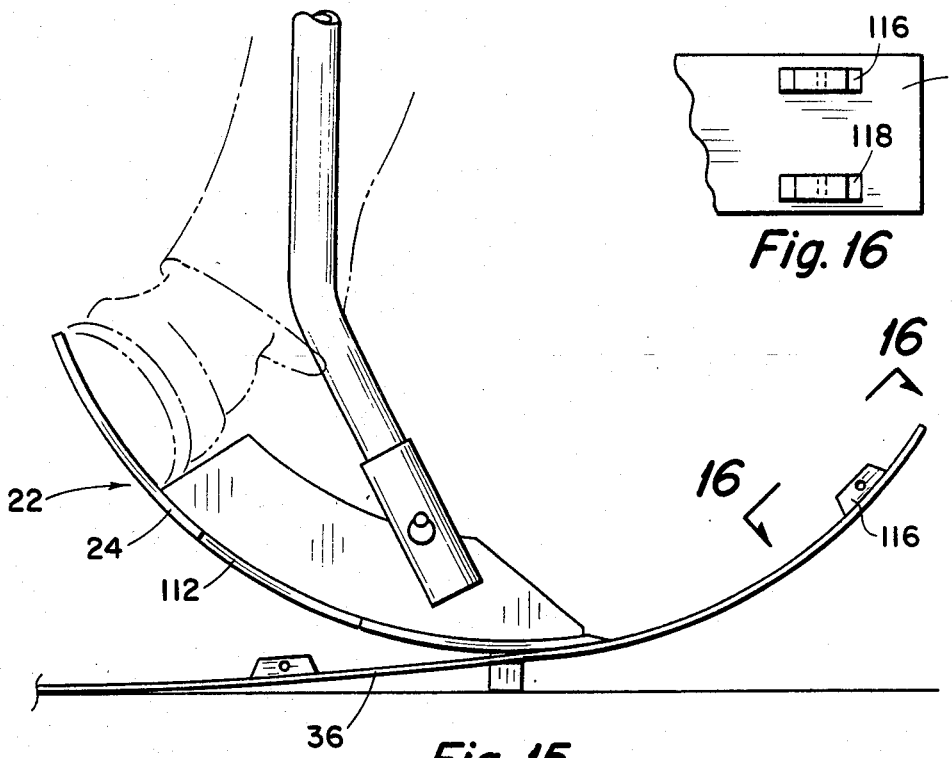
FIG. 15 is a side view of the initial position of the modified rolling shoe and work piece when used to make a large radius bend or circle in metal plate having integral projections.
Figure 17:
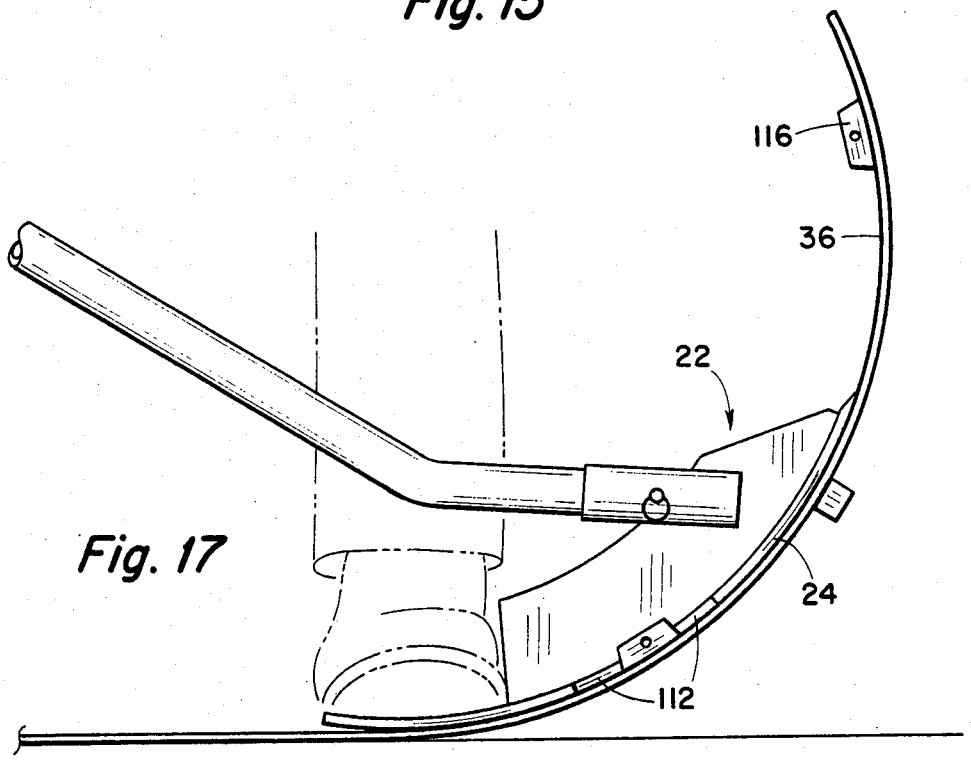
FIG. 17 is a side view of the final position of the modified rolling shoe and work piece when used to make a large radius bend or circle in metal plate having integral projections.

In an alternative embodiment of the rolling shoe 22, the curved metal plate 24 is formed having at least one opening 112 or 114 extending into each side of the curved metal plate, as illustrated in FIGS. 13 and 14. The openings 112 and 114 are provided to accommodate projections integral to the metal plate being bent when bending large radius bends or circles with the rolling shoe 22, as illustrated in FIGS. 15 and 17. One specific example of metal edging having such projections is Ryerson metal edging which has matched pairs of stake pockets 116 and 118 on one side of the edging, as illustrated in FIG. 16. The edging is normally bent with the stake pockets 116 and 118 on the inside of the bends as illustrated in FIGS. 15 and 17. The openings 112 and 114 will allow the present invention to be used for bending the Ryerson metal edging and other similar edgings.

In the example embodiment, one opening 112 or 114 is centered at the center of the arc on each side of the curved metal plate 24 as illustrated in FIGS. 13 and 14. In the example embodiment, the openings 112 and 114 are rectangular, as illustrated in FIGS. 13 and 14, and extend about 4 inches along the arc of the curved metal plate 24 and about $1\frac{3}{4}$ inches transversely from the arcuate edge of the curved metal plate into the curved metal plate 24, although the openings may be made of any size and shape to accommodate various sizes and shapes of projections.

Figure 18:
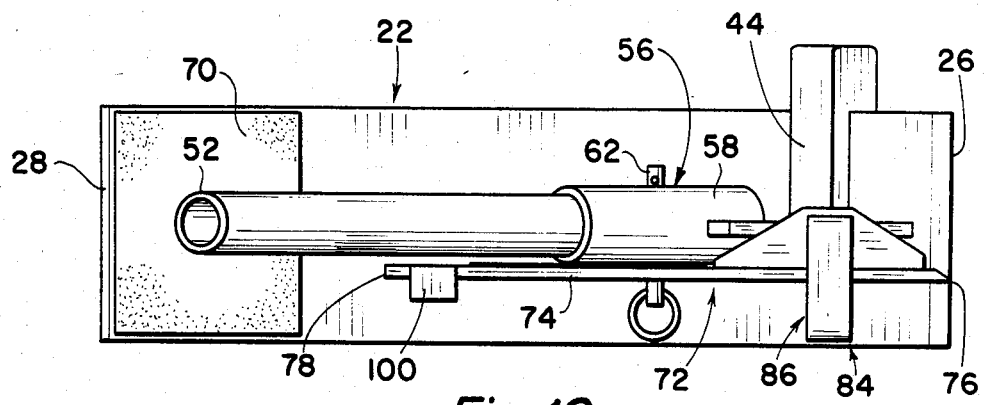
FIG. 18 is a top view of the metal plate bending device assembled for transportation, as viewed along line 18—18 of FIG. 19.
Figure 19:
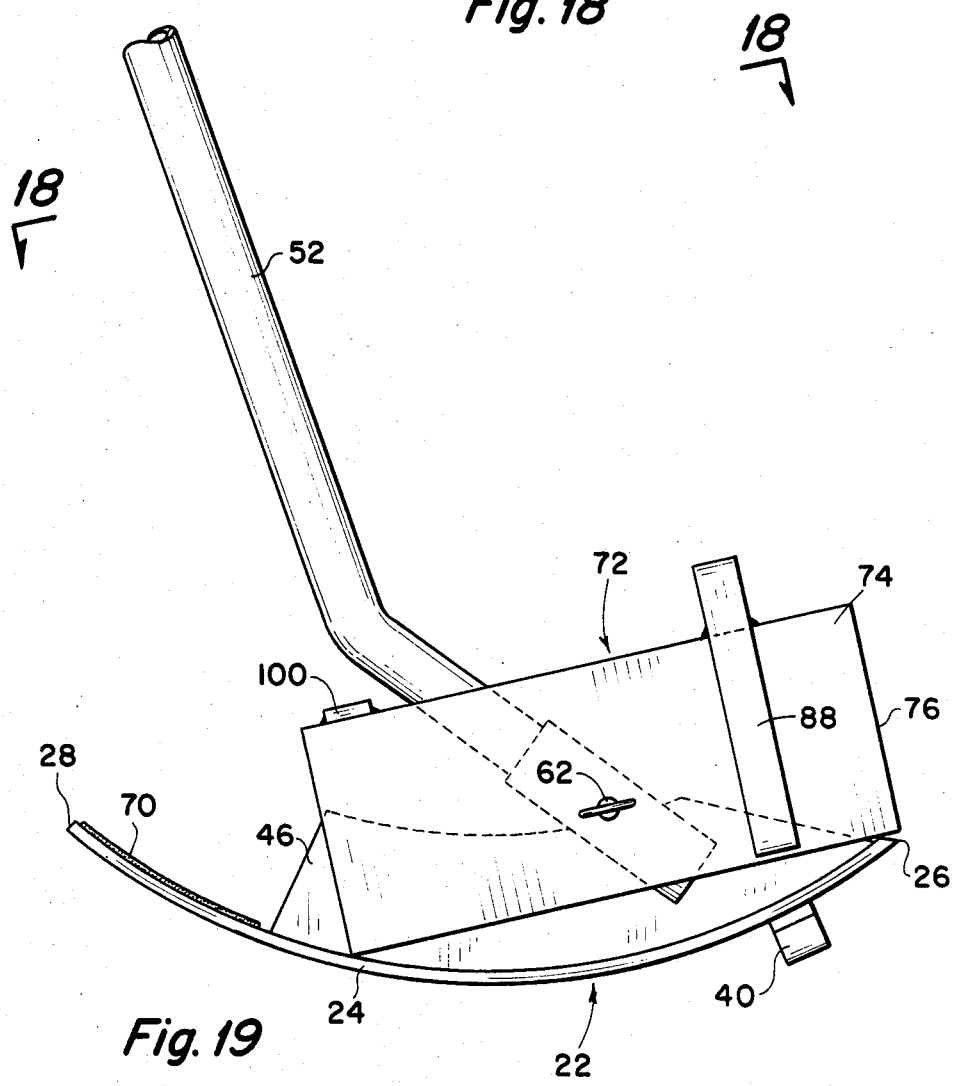
FIG. 19 is a side view of the metal plate bending device assembled for transportation.

When the bending device 20 is not in use and is to be transported, the stationary shoe 72 and handle 52 may be concurrently attached to the rolling shoe 22 with the attachment means 56 in order to carry the rolling shoe 22, stationary shoe 72, and handle 52 as a single assembly, as illustrated in FIGS. 18 and 19. In the example embodiment, a hole 120 is provided approximately in the center of the planar metal plate 74 of the stationary shoe 72, as best seen in FIG. 4. The hole 120 is the same diameter as diametrical hole 60 in the metal socket 58 and handle 52. When the bending device 20 is to be transported the hole 120 is aligned coaxially with the diametrical hole 60 and the pin 62 is placed through the holes 60 and 120, pinning the handle 52, rolling shoe 22, and stationary shoe 72 together. The stationary shoe may then easily be carried with the rolling shoe 22 by handle 52.

What is claimed is:

1. A device for making large radius bends or circles and small radius bends or right angles in metal plate, comprising:

a rolling shoe comprised of a curved metal plate having a first end, a second end, an outside bottom surface, and an inside top surface;

a handle attached to the the rolling shoe;

first retention means for receiving and retaining a workpiece of metal plate to be bent against the outside surface of the rolling shoe;

a stationary shoe comprised of a substantially planar metal plate, the stationary shoe having a first end, a second end, a top surface, and a bottom surface; and a second retention means for receiving and retaining the workpiece against the bottom surface of the stationary shoe; and wherein the stationary shoe is placed in tandem with the rolling shoe with the first end of the stationary shoe being adjacent the first end of the rolling shoe with the top surfaces of the shoes facing upward, the workpiece extending through the first and second retention means and being received and retained by the first and second retention means in order that the workpiece may be bent by moving the handle in such a manner as to roll the rolling shoe towards the stationary shoe.

2. The device of claim 1 in which the first retention means further comprises:

a first retaining block for retaining the workpiece, the first retaining block having an arm extending transversely across the outside surface of the rolling shoe near the first end of the rolling shoe, the arm of the first retaining block being spaced away from the outside surface of the rolling shoe to create a first receiving space, the first receiving space receiving and retaining the workpiece.

3. The device of claim 1 wherein the handle is attached on the inside surface near the first end of the rolling shoe; and wherein the handle is generally radially mounted with the longitudinal axis of the handle also being substantially parallel with a radial plane of the rolling shoe.

4. The device of claim 3 wherein the handle is bent, the handle being oriented such that the inside angle of the bend is in a plane substantially parallel with a radial plane of the rolling shoe.

5. The device of claim 4 further comprising:

attachment means for removably attaching the handle to the rolling shoe; and wherein the handle may be engaged within the attachment means in at least two positions: a first position having the inside angle of the bend in the handle facing the first end of the rolling shoe for use when the rolling shoe is used to bend large radius bends or circles in metal plate, and a second position having the inside angle of the bend in the handle facing the second end of the rolling shoe for use when the rolling shoe is used with the stationary shoe to bend small radius bends or right angles in metal plate.

6. The device of claim 5 wherein the stationary shoe and handle may be concurrently attached to the rolling shoe with the attachment means in order to carry the rolling shoe, stationary shoe, and handle as a single assembly.

7. The device of claim 1 wherein the inside surface near the second end of the rolling shoe further comprises:

a first footing surface, the first footing surface being a surface that is clear of obstructions over an area extending from the second end along the curvature of the inside surface of the rolling shoe, the first footing surface being used as a foot-operated lever with the outside surface of the rolling shoe functioning as a fulcrum and thereby providing a source of additional mechanical advantage when the rolling shoe is used for bending large radius bends or circles in metal plate.

8. The device of claim 7 wherein the first footing surface is covered with a covering having a high coefficient of friction.

9. The device of claim 1 in which the rolling shoe further comprises:

at least one structural support mounted along an arc of the inside surface of the rolling shoe, the structural support extending from near the first end of the inside surface of the rolling shoe at least three-fourths of the distance to the second end of the inside surface of the rolling shoe; and wherein the handle is attached to at least one of the structural support or the inside surface near the first end of the rolling shoe; and wherein the handle is generally radially mounted with the longitudinal axis of the handle being substantially parallel with a radial plane of the rolling shoe; and wherein the handle is bent, the handle being oriented such that the inside angle of the bend is in a plane substantially parallel with a radial plane of the rolling shoe; and wherein the rolling shoe further comprises:

attachment means for removably attaching the handle to the rolling shoe; and wherein the handle may be engaged with the attachment means in at least two positions: a first position having the inside angle of the bend in the handle facing the first end of the rolling shoe for use when the rolling shoe is used to bend large radius bends or circles in metal plate, and a second position having the inside angle of the bend in the handle facing the second end of the rolling shoe for use when the rolling shoe is used with the stationary shoe to bend short radius bends or right angles in metal plate.

10. The device of claim 1 wherein the first end of the rolling shoe is beveled, the angled face of the bevel being coterminous with the inside top surface of the rolling shoe; and wherein the first end of the stationary shoe is beveled, the angled face of the bevel being coterminous with the top surface of the stationary shoe.

11. The device of claim 1 in which the second retention means further comprises:

a second retaining block for retaining the workpiece, the second retaining block having an arm extending transversely across the bottom surface of the stationary shoe near the first end of the stationary shoe, the arm of the second retaining block being spaced away from and not touching the bottom surface of the stationary shoe to create a second receiving space, the second receiving space receiving and retaining the workpiece.

12. The device of claim 1 in which the top surface adjacent the second end of the stationary shoe further comprises:

a second footing surface, the second footing surface being a surface that is substantially planar and clear of obstructions over an area of the top surface extending from the second end of the stationary shoe, the second footing surface allowing the top surface near the second end of the stationary shoe to be used by the operator as a foot rest to stabilize the metal bending device when the stationary shoe is used with the rolling shoe to bend short radius bends or right angles in metal plate.

13. The device of claim 12 wherein the second footing surface is covered with a covering having a high coefficient of friction.

14. The device of claim 1 in which the stationary shoe further comprises:

alignment means for retaining the work piece in alignment with the longitudinal axis of the stationary shoe and the rolling shoe.

15. The device of claim 14 wherein the alignment means is an alignment block located near the second end on one side of the stationary shoe, the alignment block having an alignment face which is coterminous with the side of the stationary shoe, the alignment face extending from the side of the stationary shoe beyond the bottom surface of the stationary shoe, the alignment face being flush with the side of the stationary shoe and perpendicular to the bottom surface of the stationary shoe.

16. The device of claim 1 wherein the curved metal plate further comprises:

at least two openings, one opening extending into each side of the curved metal plate, the openings being provided to accommodate projections integral to the metal plate being bent.

17. The device of claim 16 wherein one opening is centered at the center of the arc on each side of the curved metal plate, each opening extending from the arcuate edge of the curved metal plate into the curved metal plate.

18. A device for bending metal plate, comprising:

a rolling shoe comprised of a curved metal plate having a first end, a second end, an outside bottom surface, and an inside top surface;

a handle attached to the rolling shoe; and first retention means for receiving and retaining a workpiece of the metal plate to be bent against the outside bottom surface of the rolling shoe.

19. The device of claim 18 in which the first retention means further comprises:

a first retaining block having an arm extending transversely across the outside surface of the rolling shoe near the first end of the rolling shoe, the arm of the first retaining block being spaced away from the outside surface of the rolling shoe to create a first receiving space, the first receiving space receiving and retaining the workpiece.

20. The device of claim 18 wherein the handle is attached on the inside surface near the first end of the rolling shoe; and wherein the handle is generally radially mounted with the longitudinal axis of the handle being substantially parallel with a radial plane of the rolling shoe.

21. The device of claim 20 wherein the handle is bent, the handle being oriented such that the inside angle of the bend generally faces the first end of the rolling shoe.

22. The device of claim 21, further comprising:

attachment means for removably attaching the handle to the rolling shoe and properly orienting the inside angle of the handle with respect to the rolling shoe.

23. The device of claim 18 wherein the inside surface near the second end of the rolling shoe further comprises:

a first footing surface, the first footing surface being a surface that is clear of obstructions over an area extending along the curvature of the inside surface of the rolling shoe, the first footing surface being used as a foot-operated lever with the outside surface of the rolling shoe functioning as a fulcrum and thereby providing a source of additional mechanical advantage for bending metal plate.

24. The device of claim 23 wherein the first footing surface is covered with a covering having a high coefficient of friction.

25. The device of claim 18 in which the rolling shoe further comprises:

at least one structural support mounted along an arc of the inside surface of the rolling shoe, the structural support extending from near the first end of the inside surface of the rolling shoe at least three-fourths of the distance to the second end of the inside surface of the rolling shoe; and wherein the handle is attached to at least one of the structural support or the inside surface near the first end of the rolling shoe; and wherein the handle is generally radially mounted with the longitudinal axis of the handle being substantially parallel with a radial plane of the rolling shoe; and wherein the handle is bent, the handle being oriented such that the inside angle of the bend generally faces the first end of the rolling shoe; and wherein the rolling shoe further comprises:

attachment means, mounted on at least one of the structural support or the inside surface of the rolling shoe, for removably attaching the handle to the rolling shoe.

26. The device of claim 18 wherein the curved metal plate further comprises:

at least two openings, one opening extending into each side of the curved metal plate, the openings being provided to accommodate projections integral to the metal plate being bent.

27. The device of claim 25 wherein one opening is centered at the center of the arc on each side of the curved metal plate, each opening extending from the arcuate edge of the curved metal plate into the curved metal plate.

* * * * *